United States Patent [19]

Kratz

[11] Patent Number: 4,722,099

[45] Date of Patent: Feb. 2, 1988

[54] PROTECTIVE MOTORCYCLE GARMENTS FOR MAXIMUM COOLING

[76] Inventor: Richard F. Kratz, 333 E. Fairview, #113, Glendale, Calif. 91207

[21] Appl. No.: 936,615

[22] Filed: Dec. 1, 1986

[51] Int. Cl.[4] ..... A41D 1/02; A41D 13/02; A41D 1/06

[52] U.S. Cl. ..... 2/79; 2/82; 2/93; 2/115; 2/227; 2/DIG. 1

[58] Field of Search ..... 2/DIG. 1, 87, 108, 93, 2/79, 82, 115, 161 A, 227, 228, 46

[56] References Cited

U.S. PATENT DOCUMENTS

| | | | |
|---|---|---|---|
| 3,045,243 | 7/1962 | Lash et al. | 2/87 X |
| 3,153,793 | 10/1964 | Lepore | 2/DIG. 1 |
| 3,213,465 | 10/1965 | Ludwikowski | 2/87 |
| 3,296,626 | 1/1967 | Ludwikowski | 2/DIG. 1 |
| 3,761,962 | 10/1973 | Myers | 2/79 |
| 3,969,772 | 7/1976 | Pravaz | 2/79 |
| 4,185,327 | 1/1980 | Markve | 2/79 |
| 4,513,451 | 4/1985 | Brown | 2/DIG. 1 |
| 4,576,087 | 3/1986 | Wolfe | 2/87 |

FOREIGN PATENT DOCUMENTS

| | | | |
|---|---|---|---|
| 1145808 | 5/1957 | France | 2/DIG. 1 |
| 2104770 | 3/1983 | United Kingdom | 2/DIG. 1 |

*Primary Examiner*—H. Hampton Hunter
*Attorney, Agent, or Firm*—Boniard I. Brown

[57] ABSTRACT

Conductive and evaporative cooling are provided in a natural or artificial leather motorcycle garment by including mesh vents at locations which require little protection, such as adjacent the underarms extending from chest to back, inside the elbows, and at the neck. Scoops which open in response to a predetermined air flow velocity and constrict in response to higher velocities are also provided. The scoops are positioned at the top of the shoulders, at the outside of the knees, and at the lower outer thighs so that a positive flow of air is established throughout the garment at speeds over 5 miles an hour for removal of heat from the body at a comfortable rate. The back is allowed to billow slightly to provide a air flow conduit across the back and prevent contact heating from solar radiant effects. A fire proof gabardine panel is provided in the crotch area and on the inside of the knees where evaporative cooling is required yet maximum protection is needed.

24 Claims, 10 Drawing Figures

PROTECTIVE MOTORCYCLE GARMENTS FOR MAXIMUM COOLING

BACKGROUND OF THE INVENTION

In many sport and adventuresome events, such as motorcycle riding, it is prudent to wear an abrasive resistant outer garment for protection in case of spills. When being ridden, a motorcycle provides very little protection to the cyclist while being very susceptible to actions which separate the cyclist from the motorcycle at high speed, either through collision with an object or other vehicle, a momentary loss of balance or an abrupt change in speed or direction of travel due to sudden changes in the terrain. When a cyclist is thrown or jumps free from a motorcycle during times of emergency, the severity of injuries sustained can be reduced substantially if the cyclist's body is not subject to tearing injuries due to the glancing impacts with the fuel tank and handle bars of the motorcycle, burn injuries caused by vaporized fuel generated by the impact and skin injuries caused by abrasive sliding contact between the cyclist and the ground.

As sport cyclists have become more safety minded, they, like racers, have desired protective jackets and pants constructed from leather or leather-like materials. This is because leather garments are soft enough to be comfortable and to allow unrestrictive movement while protecting the wearer against cold and wet weather, and high speed spills. Unfortunately, for many, motorcycling is a summer activity in weather conditions of high heat and humidity. Leather garments, being relatively non-porous, act to retain the metabolic heat of a body. The heat retention makes "leathers" extremely uncomfortable, and causes the wearer to discard them on hot days, thereby increasing the risk of serious injury.

In the past, many attempts have been made to provide protective leathers which are ventilated to provide some cooling to a motorcyclist. For example, air passages or spacers are provided in garments shown in U.S. Pat. Nos. 3,213,465, 3,296,626 and 3,045,243. Other garments have provided ventilating slits to allow hot air to escape from inside a protective garment such as shown in U.S. Pat. No. 3,153,793. In other cases mesh panels such as shown in U.S. Pat. No. 3,761,962 or openable mesh panels such as shown in U.S. Pat. No. 4,513,451 have been provided. In U.S. Pat. No. 4,570,269 fixed, forwardly facing air scoops are provided on a hard protective glove to ventilate the hands of a cyclist. These features notwithstanding, a satisfactory protective garment which can provide the cooling equivalent of bare skin at speeds as slow as 5 miles an hour is desirable, so that the sport of motorcycling can be enjoyed safely during hot and humid summer months. It also is desirable that the protective garment be versatile enough to be used during periods of less heat and humidity.

SUMMARY OF THE PRESENT INVENTION

The present protective suit for motorcyclists and others subject to the same dangers and air flow exposures includes pants and a jacket. The jacket preferably is constructed from natural or artificial leather, and includes mesh vents which extend from the armpits forward on the chest and rearward toward the back to allow a majority of the cooling air flow. Mesh vents also are provided on the inside of the elbows and at the neck. All five of these locations are areas where a motorcyclist needs little protection from abrasion. In addition, forward facing closable scoops are positioned at the top of each shoulder to provide forced air flow down into the back area between the armpit vents. The back area is sized and constructed to allow a slight billowing to provide air passageways across the back and to the armpit mesh areas. The shoulder scoops each usually include snaps for holding them closed and a mesh across their entrance to prevent the entry of bugs and debris. The scoops are formed by providing slightly more material on the exterior portion of the scoop than its interior so that the Bernoulli effect of air passing over a cyclist's shoulders holds the scoops open unless held closed by the snaps. A loose flap across the rear of each scoop causes it to start choking down at speeds of approximately 55 mph where additional air flow can reduce cooling effects during hot and humid conditions.

The pants garment also is constructed mainly from natural or artificial leather and it includes two similar pairs of scoops. Two vertical scoops are positioned along the outside of the knees to provide forced air flow for the knees and lower leg portions while two horizontal scoops are positioned adjacent the outside lower thighs. When the cyclist sits, these thigh scoops become vertical to provide air flow to the upper legs. A crotch panel and inner calf panels of the pants are constructed from a fireproof gabardine material to allow wicking of moisture from the crotch area for evaporative cooling and a small conductive air flow while providing protection against impact with the motorcycle and fire protection.

The suit is fit to provide just enough clearance with the body to allow air flow without creating large flapping areas. Cuffs at the wrists and ankles are cut so that air can flow therethrough without creating large folds of loose material which flap to create drag and discomfort.

Therefore, it is an object of the present invention to provide a protective suit for a motorcyclist which at 5 miles an hour can be the thermodynamic equivalent of riding naked.

Another object is to provide ventilated protective clothing where the ventilation is provided in areas which allow maximum cooling with minimum danger.

Another object is to provide protective clothing with variable ventilation scoops which automatically provide the desired air flow without flapping, yet can be kept closed during cooler weather.

Another object is to provide a motorcycle suit which provides maximum protection and comfort during hot weather riding.

These and other objects and advantages of the present invention will become apparent to those skilled in the art after considering the following detailed specification together with the accompanying drawings wherein:

DETAILED DESCRIPTION OF THE SHOWN EMBODIMENT

Figure 1:
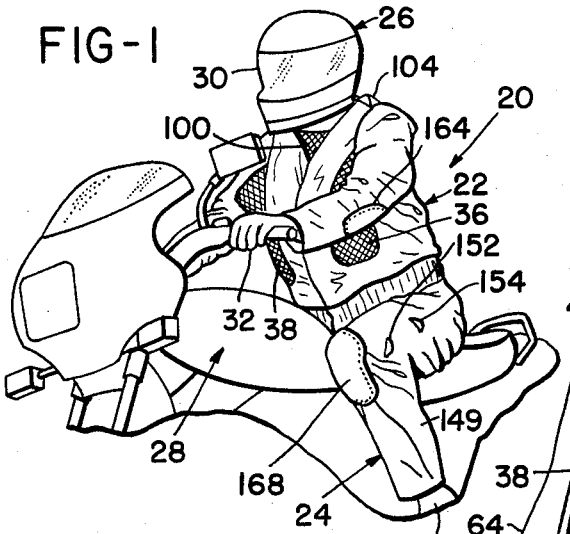
FIG. 1 is a partial perspective view of a motorcyclist riding a motorcycle dressed in the present invention.

Referring to the drawings more particularly by reference numbers, number 20 in FIG. 1 refers to a protective motorcycle suit including a jacket 22 and pants 24 being worn by a cyclist 26 riding a motorcycle 28. The suit 20 is constructed primarily from abrasive resistant material such as natural or artificial leather. The suit 20 is designed to provide enough ventilation to keep the cyclist 26 comfortable by providing significant air flow over 80% of the cyclist's upper torso and no less than 20% of the rider's lower extremities. Although comfort is subjective, varying from cyclist to cyclist, the cooling efficiency for the suit 20 can be calculated using two measures of cooling efficiency under four weather conditions.

The measures of cooling efficiency can be the speed at which maximum possible cooling due to perspiration/evaporation occurs and the percentage of the maximum possible cooling at various speeds. In the following calculations, these figures are comparative. That is, they represent an improvement in cooling over a prior art full leather suit with both the present suit 20 and a full leather suit being worn by a rider who is assumed to be wearing a full face helmet 30, gloves 32, and leather shoes 34 also.

Four relative weather conditions, jungle summer, desert summer, humid city summer and dry city summer are shown in Table 1. While these temperatures and relative humidities certainly do not represent the extremes which can be encountered by a cyclist 26, they are typical maximum hot weather riding conditions encountered by most riders. Hotter, dryer weather would lead to even better evaporative cooling.

TABLE 1

| | Air Temp. °F. | Relative Humidity |
|---|---|---|
| Jungle Summer | 100° | 70% |
| Desert Summer | 100° | 20% |
| Humid City Summer | 80° | 70% |
| Dry City Summer | 80° | 40% |

There are four separate ways in which heat is transferred to and from a human body. It is necessary for the heat subtracted from the body to equal the heat added to the body. Otherwise, the body temperature rises above acceptable limits and serious physiological consequences ensue. The relationship between the various portions of this "heat balance" can be represented by Equation (1)

$$M+C_{in}+R_{in}=C_{out}+E_{out} \quad (1)$$

where M equals the metabolic heat generated by the body using food, $C_{in}$ equals convection heating of the body (which occurs only when the air temperature is greater than approximately 95° F.), $R_{in}$ represents the radiant heat load (the heat absorbed directly by the body from the sun and other surrounding objects hotter than the body), $C_{out}$ equals the convection of heat from the body (which is away from the body only when the air temperature is cooler than 95° F.), and $E_{out}$ equals the heat loss of the body caused by the evaporation of perspiration. This equation somewhat simplifies the heat balance that a body experiences, but is precise enough to allow understanding of the thermodynamic characteristics of summer motorcycle riding.

For all practical purposes, the heat generated by M and $R_{in}$ is the same for a cyclist 26 riding in prior art full leathers or the suit 20 of the present invention. For full leathers, very little heat loss is generated by the evaporation of perspiration. This is why full leathers are so intolerable when the temperature rises above 95° F. Therefore, the parameters that are important in calculating the improvement provided by the present suit 20 over that provided by full leathers is the increase or decrease of convective heat transfer to or from the body and the increase in evaporative heat transfer.

The improvement in cooling performance provided by the present suit 20 over conventional full leathers may be expressed as Equation (2)

$$Improvement=E_{sum}-E_{fl}+C_{sum}-C_{fl} \quad (2)$$

where $E_{sum}$ equals the evaporative cooling available with summer leathers, $E_{fl}$ equals the evaporative cooling available from full leathers (essentially zero), $C_{sum}$ equals the convective heat transfer to or from the body with summer leathers, and $C_{fl}$ equals such convective heat transfer with full leathers.

When the atmospheric temperature is above the skin temperature or approximately 95° F., the convective heat transfer to the body from the hotter air is greater with the present suit 20 than with full leathers. This represents a slight decrease in cooling capacity. However, the much more significant effect is the tremendous increase in evaporative cooling available when the suit 20 is worn. Table 2 shows the results of the use of Equation (2) to calculate the minimum speed for max evaporative cooling in miles per hour and the percent increase in net cooling at a given speed in miles per hour.

TABLE 2

| | Min. Speed for Max. Evap. Cooling | % Increase in Net Cooling at Given Speeds | | | |
|---|---|---|---|---|---|
| | | 5 mph | 10 mph | 25 mph | 55 mph |
| Jungle Summer | 25 mph | 23% | 34% | 60% | 96% |
| Desert Summer | 2 mph | 100% | 100% | 100% | 100% |
| Humid City Summer | 4 mph | 100% | 100% | 100% | 100% |
| Dry City Summer | 3 mph | 100% | 100% | 100% | 100% |

The percentages expressed are the percentages of the maximum evaporative cooling available. Therefore, an increase of 100% would indicate an increase of body heat rejection of 600 kilocalories per hour, which is an average maximum heat rejection for a standard human. It should be noted that the net cooling even in the most severe condition, jungle summer, increases to 60% of possible at only 25 miles per hour and 96% of possible at 55 miles an hour, and that even at 5 miles per hour, a 100% increase in net cooling occurs in anything less than the most severe jungle summer conditions. However, during jungle summer conditions, speeds in excess of 60 mph result in 100% evaporation and thereafter further airflow acts to heat the cyclist 26 rather than cool him. Therefore, under such conditions, it is desirable to decrease the total air flow over the cyclist 26 to that experienced at 55 miles an hour.

Figure 2:
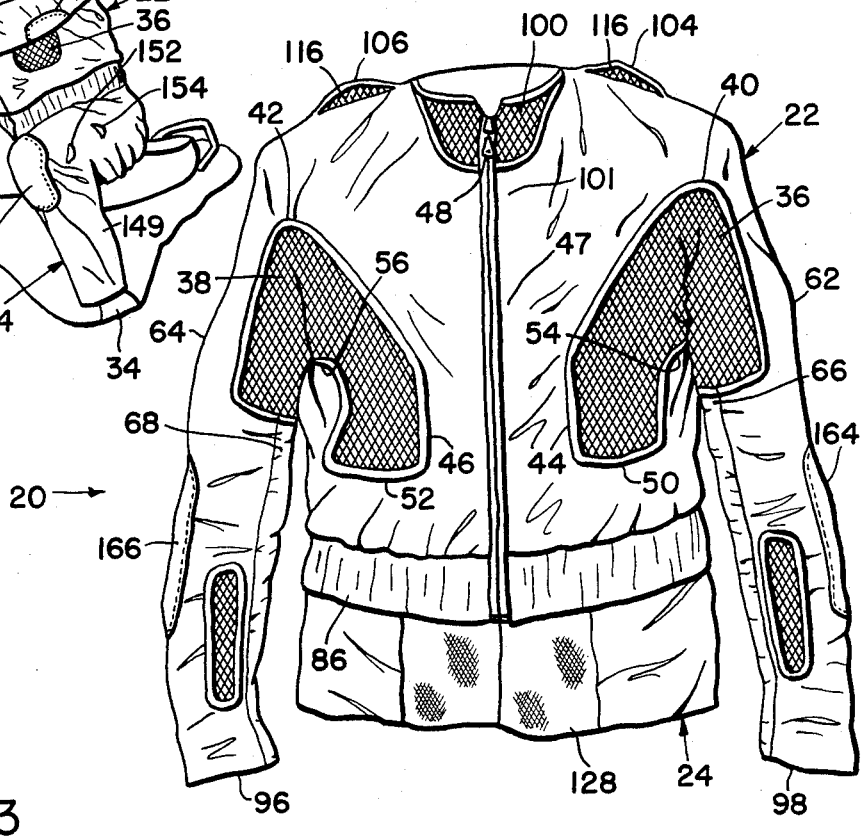
FIG. 2 is a front elevational view primarily of the jacket portion of the present invention.
Figure 3:
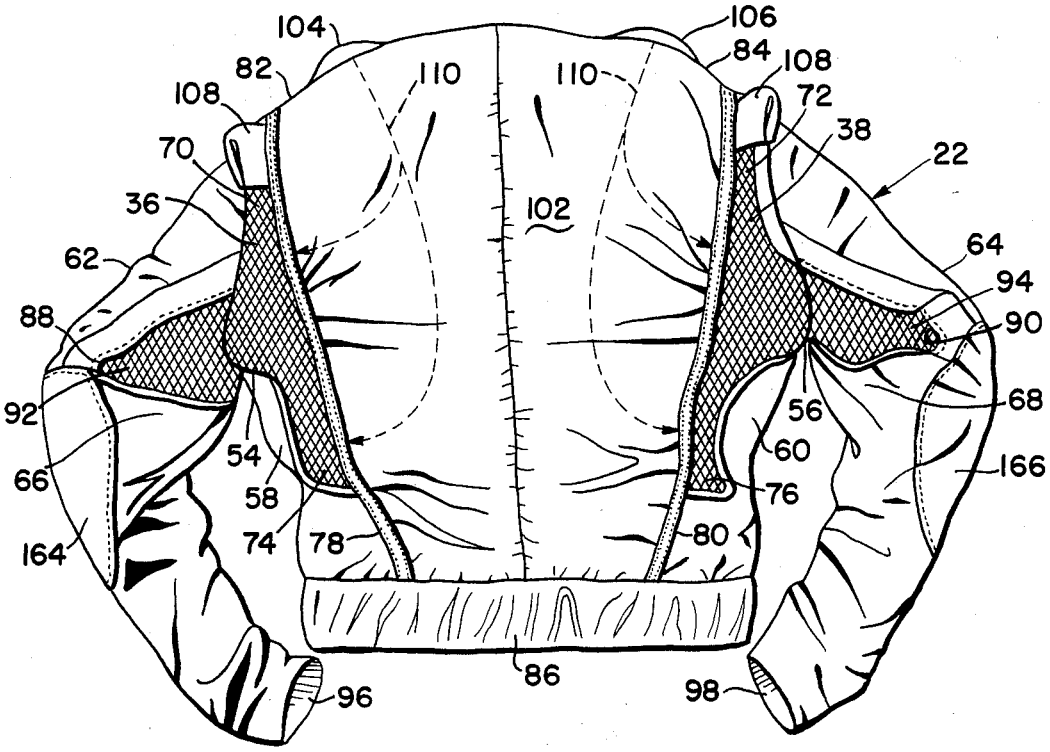
FIG. 3 is a back elevational view of the jacket portion of the present invention.

The means to provide the desired ventilation without substantially decreasing the protection afforded by the suit 20 are shown with respect to the jacket 22 in FIGS. 2 and 3. The jacket 22 includes a mirror image pair of armpit vents 36 and 38. The vents 36 and 38 have their maximum front height at mid-shoulder locations 40 and 42. From there, the vents extend downwardly and inwardly to locations 44 and 46, approximately two-thirds the distance across the chest 47 to the center closure shown as zipper 48. From there, the vents 36 and 38 extend downwardly to lower portions 50 and 52 generally corresponding to the bottom of the cyclist's rib cage. As the lower edges 54 and 56 of the vents 36 and 38 extend under the armpits of the cyclist 26, they again rise upwardly to provide areas 58 and 60 of protective leather adjacent the armpits of the cyclist 26. This is because in the case of a spill, it is rare for a cyclist 26 to be contorted such that an armpit can drag but adjacent ribs are commonly abraded. From the locations 40 and 42, the vents 36 and 38 also extend down the arms 62 and 64 of the jacket 22 generally parallel to the arms 62 and 64 but on the inner portions 66 and 68 thereof. As can be seen in FIG. 3, the vents 36 and 38 extend to the rear from the armpit upwardly and downwardly to provide upper and lower back portions 70 and 72, and 74 and 76 which extend to reinforcing ribs 78 and 80. The reinforcing ribs 78 and 80 extend from the shoulders 82 and 84 to the waistband 86. The vents 36 and 38 also extend from the armpits downwardly and outwardly to positions 88 and 90 on the inner rear arm just above the elbow. The vents 36 and 38 are so shaped and positioned to provide maximum air flow utilizing those areas of the jacket 22 which are least likely to come into abrasive contact with the pavement or other surface during an accident. Elbow vents 92 and 94 which are shown relatively larger in the vertical direction than the horizontal direction are provided in the arms 62 and 64 at the cyclist's inner elbows, which areas are very rarely abraded, to provide ventilation for the sleeves 62 and 64 of the jacket 22. As shown in FIG. 3, the cuffs 96 and 98 neck down but allow a hand to be moved therethrough so that when they are in position on a cyclist 26, air passages are provided adjacent the wrist up the cuffs 96 and 98 without providing large flapping openings which could be caught and ripped by a fixed or moving object during an accident. Another vent 100 is provided adjacent the rider's throat, another area where there is little danger of contact with the pavement. The vent 100 is split by the zipper 48 but assures that hot air is not trapped on the forward upper chest 101 of the rider 26.

Figure 4:
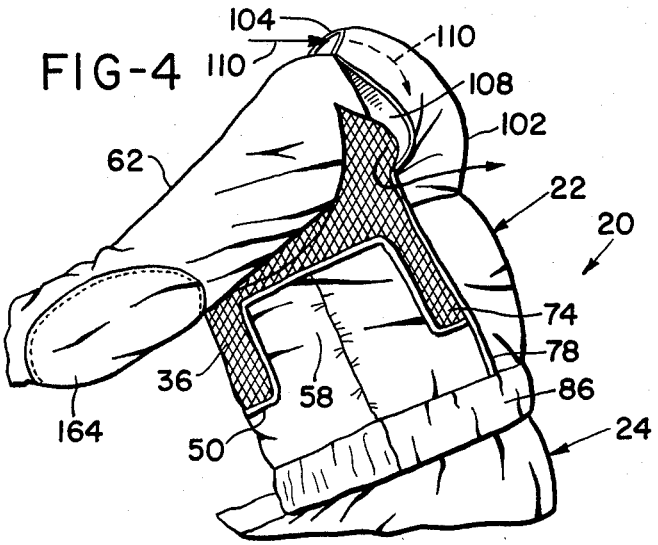
FIG. 4 is a side elevational view of the jacket of the present invention as it appears on a cyclist riding on a motorcycle with a relative air speed of at least 5 miles an hour.
Figure 5:
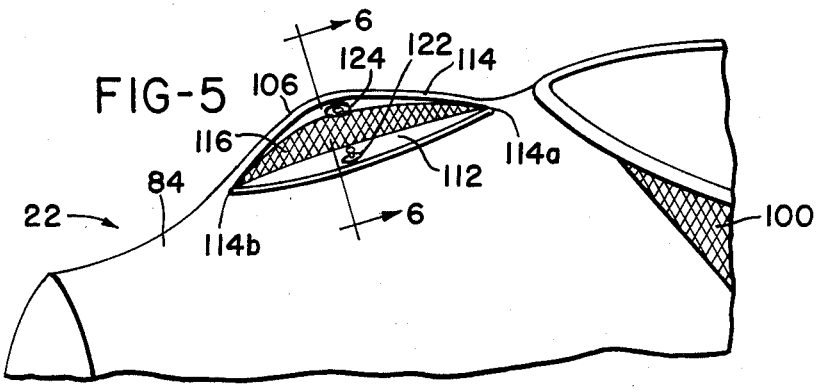
FIG. 5 is an enlarged detail front view of a ventilating scoop employed on the jacket of the present invention.
Figure 6:
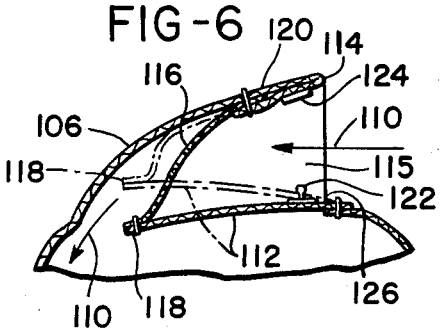
FIG. 6 is across sectional side view of the scoop of FIG. 5 taken on line 6—6 therein.

To provide adequate protection, the back 102 of the jacket 22 must be constructed from abrasion-resistant material. Therefore, the back 102 is used as a conduit for cooling air which is provided by two closeable scoops 104 and 106 positioned at the top of the shoulders 82 and 84. Their operation is shown in more detail in FIGS. 4, 5 and 6. As can be seen in FIG. 4, small gussets 108 are provided between the vents 36 and 38 and the back 102. Therefore air, illustrated by the arrows 110, gathered by the scoops 104 and 106 is forced down the back 102. The gussets 108 allow the back 102 to billow slightly to provide an air passage down the back 102 and out the vents 36 and 38. As shown in FIGS. 5 and 6, the scoops, with scoop 106 being shown, are each constructed having an inner and outer flap 112 and 114. The outer flap 114 is slightly longer side to side **114*a* and 114*b*, across the mouth 115 of the scoop 106 than flap 112 to create a natural tendency for the scoop 106 to open as shown in FIG. 5. The flap 112 extends inwardly underneath flap 114 and preferably a flexible cloth mesh 116 extends from the rearward portion 118 of the flap 112 to the forward leading edge 120 of the flap 114. The mesh 116 is provided to screen out bugs or other debris which otherwise might pass through the scoop 106**.

Air flow over the shoulder 84 tends to keep the mouth 115 of the scoop 106 open as shown in FIG. 5 unless retained in a closed position by means of the snaps 122 and 124 positioned against the leading edges 120 and 126 of the flaps 114 and 112. However, as shown in Table 2, since it is undesirable to provide more air flow than can be used for evaporation, especially under jungle summer conditions, the trailing edge 118 of the flap 112 is unsupported so that the venturi action of air 110 at higher speeds tends to move the trailing edge 118 of the flap 112 upwardly to the position shown in dashed outline in FIG. 6 to limit the flow of air 110 through the scoop 106 above 55 mph.

Figure 7:
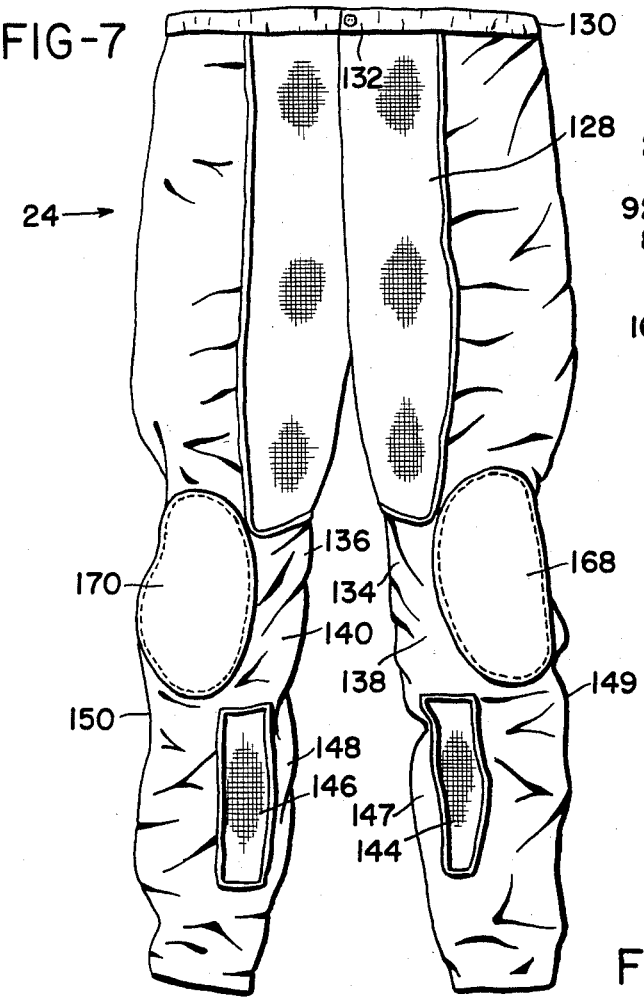
FIG. 7 is a front elevational view of the pants of the present protective suit.
Figure 8:
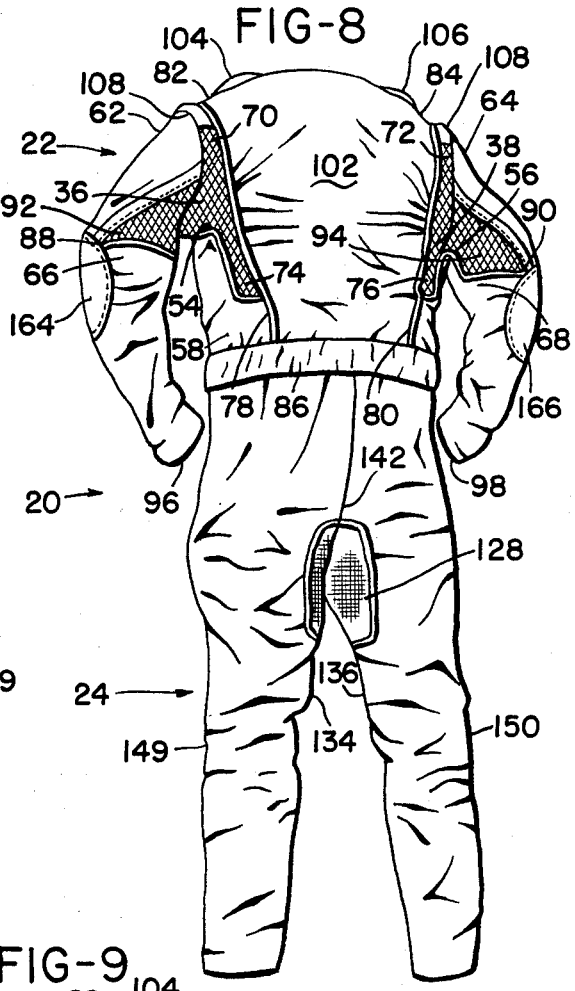
FIG. 8 is a rear perspective view of the suit of the present invention as it appears on a cyclist in a standing position.
Figure 9:
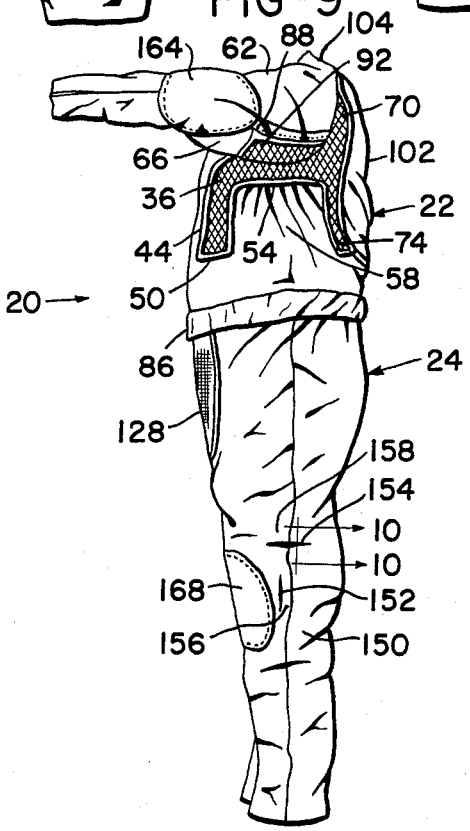
FIG. 9 is a side elevational view of the suit of the present invention as it appears on a cyclist standing but with arms in positions similar to those used to ride a motorcycle.

The pants 24 as shown in FIGS. 7, 8 and 9 include a gabardine crotch panel 128 which extends from the belt 130 in the front 132 of the pants 24 down the inside pants legs 134 and 136 to just above the knee areas 138 and 140. The panel 128 is located in an area of extreme danger since when a cyclist collides while still on the cycle 28, this is the area that tends to snag obstructions on the motorcycle and be doused with gasoline when it vaporizes out of a broken tank. Therefore, the panel 128 is constructed from gabardine material made with a combination of Kevlar and Polybenzimidazole (PBI) which is tough, soft, comfortable and will not burn at normal atmospheric pressure. It should be noted in FIG. 8 that the panel 128 only extends up to the seat area 142 in the rear since the seat area 142 is not exposed to the air during normal riding.

Additional gabardine panels 144 and 146 are provided in the inner lower calf areas 147 and 148 of the pants 24. These allow some evaporative wick cooling, a modest amount of air flow and at the same time are fire resistant to protect the rider against hot engine parts. The ventilation for the legs 149 and 150 of the pants 24 is provided by pairs of vertical and horizontal scoops 152 and 154 respectively. As shown in FIG. 9, the vertical scoops 152 are located at the outer edge 156 of the legs 149 and 150 adjacent the knee areas 138 and 140. They are vertical and remain so even when the cyclist 26 is sitting on the motorcycle 28, to allow air entry and ventilation of the knees and lower legs. The horizontal scoops 154 are located in the outer lower thigh areas 158. As shown in FIG. 1, the scoops 154 become vertically oriented when the cyclist 26 is seated on the motorcycle 28 to ventilate the thigh areas. The scoops 152 and 154 are constructed similarly to scoops 104 and 106 as a cross section of a horizontal scoop 154 shows in FIG. 10. They each include upper and lower flaps 160 and 162 with slightly more material being provided for the upper flap 162 so that it has a natural tendency to open when presented with a flow of air to provide the desired ventilation.

Figure 10:
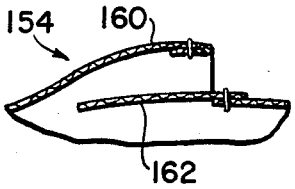
FIG. 10 is an enlarged detail cross-sectional view taken at line 10—10 in FIG. 9 showing the construction of a scoop provided on the pants typical of either the horizontal or vertical scoops.

It should be noted that scoop 154 in FIG. 10 does not include a mesh screen 116. A screen can restrict air flow and is not needed since the legs of a cyclist 26 normally are protected by the motorcycle 28 except in very bug filled environments. The maximum cooling flow allowed by elimination of the screen 116, enables the scoops 152 and 154 to be sized with minimum openings. This reduces the chances that a scoop 152 or 154 can snag on a passing object. It also should be noted that more common features of protective suits such as reinforcing elbow patches 164 and 166 and reinforcing knee patches 168 and 170 can be provided to reinforce the suit 20 in areas where extreme abrasion is likely to occur without interfering with the desired air flow.

Thus there has been shown and described a novel protective summer motorcycle suit which fulfills all of the objects and advantages sought therefore. Many changes, alterations, modifications and other uses and applications of the subject invention will become apparent to those skilled in the art after considering this specification together with the accompanying drawings. All such changes, alterations, and modifications which do not depart from the spirit and scope of the invention are deemed to be covered by the invention which is limited only by the claims which follow.

What is claimed is:

1. An air cooled protective garment including:
- a jacket having:
- a neck portion;
- a chest portion having a center;
- a back portion;
- a waist portion;
- right and left shoulder portions;
- right and left sleeves;
- right and left armpit portions under said right and left sleeves;
- an abrasion resistant outer layer; and
- similar right and left mesh armpit vents through said abrasion resistant outer layer, said right armpit vent having:
  - an upper front portion which extends partly from said right armpit to said right shoulder;
  - a lower chest portion which extends partly from said right armpit to said waist portion along said chest portion and partly toward said center thereof;
  - a lower front sleeve portion which extends partly down said right sleeve;
  - an upper rear portion which extends partly to said right shoulder along said back portion adjacent said right sleeve;
  - a lower rear portion which extends partly to said waist downwardly from said upper rear portion along said back portion; and
  - a lower rear sleeve portion which extends partly down said right sleeve from said armpit portion.

2. The air cooled protective garment as defined in claim 1 wherein said left armpit vent has:
- an upper front portion which extends partly from said left armpit to said left shoulder;
- a lower chest portion which extends partly from said left armpit to said waist portion along said chest portion and partly toward said center thereof;
- a lower front sleeve portion which extends partly down said left sleeve;
- an upper rear portion which extends partly to said left shoulder along said back portion adjacent said left sleeve;
- a lower rear portion which extends partly to said waist downwardly from said upper rear portion along said back portion; and
- a lower rear sleeve portion which extends partly down said left sleeve from said armpit portion, whereby said right and left armpit vents are mirror images of each other.

3. The air cooled protective garment as defined in claim 2 wherein said jacket further includes:
- right and left scoops positioned at said right and left shoulder portions-respectively, each scoop having:
- an upper flap; and
- a lower flap, said upper and lower flaps each having:
  - a right side; and
  - a left side, said right sides of said upper and lower flaps being connected together, said left sides of said upper and lower flaps being connected together, and said upper flap from said right side thereof to said left side thereof being longer than said lower flap from said right side thereof to said left side thereof.

4. The air cooled protective garment as defined in claim 3 wherein said lower flap of each scoop further has:
- a trailing edge which defines a throat with said upper flap, said trailing edge being loosely supported by said right and left sides so that said trailing edge can respond to venturi effects of air passing therethrough to narrow said throat at high air velocities.

5. The air cooled protective garment as defined in claim 4 wherein each scoop further includes:
- a mesh screen which extends from said upper flap to said trailing edge of said lower flap.

6. The air cooled protective garment as defined in claim 4 wherein each scoop further includes:
- fastener means on said upper and lower flaps for selectively holding said upper and lower flaps together to reduce the possible air flow therebetween.

7. The air cooled protective garment as defined in claim 3 wherein back portion includes:
- right and left reinforced portions adjacent said right and left armpit vents extending from said right and left shoulder portions to said waist portion to define an air channel from said right and left scoops down said back portion to said waist portion.

8. The air cooled protective garment as defined in claim 7 wherein said back portion further includes:
- right and left gussets adjacent said right and left sleeves and said right and left shoulders portions, whereby said right and left gussets allow said back portion to billow between said right and left reinforced portions.

9. The air cooled protective garment as defined in claim 2 further includes:
- a mesh neck vent located at said neck portion.

10. The air cooled protective garment as defined in claim 2 further includes:
- mesh inner elbow vents positioned along said right and left sleeves.

11. The air cooled protective garment as defined in claim 1 further including:
- pants, said pants having:

a front side;
a back side;
a left side;
a right side;
a top portion;
left and right leg portions which each have:
an inner thigh portion;
an outer thigh portion;
an inner knee portion;
an outer knee portion;
an inner calf portion;
an outer calf portion; and
a cuff portion, said left and right leg portions extending downwardly from said top portion;
a crotch portion between said left and right leg portions;
an abrasion resistant, generally impervious, outer layer; and
a closely woven panel positioned through said abrasion resistant, generally impervious, outer layer at said crotch portion which extends on said front side down said inner thigh portion toward said inner knee portion and upward to said top portion and which extends on said back side down said inner thigh portion toward said inner knee portion.

12. The air cooled protective garment as defined in claim 11 wherein said left and right leg portions each further include:
a closely woven panel positioned through said abrasion resistant, generally impervious, outer layer at said respective inner calf.

13. The air cooled protective garment as defined in claim 12 wherein said left and right leg portions each further include:
a knee scoop positioned at said outer knee portion, said knee scoop having:
an outer flap; and
an inner flap, said outer and inner flaps extending generally vertical and each having:
opposite sides, said opposite sides of said outer and inner flaps being connected together and said outer flap being longer side to side than said lower flap.

14. The air cooled protective garment as defined in claim 12 wherein said left and right leg portions each further include:
a thigh scoop positioned at said outer thigh portion, said thigh scoop having:
an outer flap; and
an inner flap, said outer and inner flaps extending generally horizontal and each having:
opposite sides, said opposite sides of said outer and inner flaps being connected together and said outer flap being longer side to side than said inner flap.

15. An air cooled protective garment including:
pants, said pants having:
an abrasion resistant, generally impervious, outer layer;
a front side;
a back side;
a left side;
a right side;
a top portion;
left and right leg portions which each have:
an inner thigh portion;
an outer thigh portion;
an inner knee portion;
an outer knee portion;
an inner calf portion;
an outer calf portion; and
a thigh scoop positioned at said outer thigh portion, said thigh scoop having:
an outer flap; and
an inner flap, said outer and inner flaps extending generally horizontal and each having:
opposite sides, said opposite sides of said outer and inner flaps being connected together and said outer flap being longer side to side than said inner flap.

16. The air cooled protective garment as defined in claim 15 wherein said left and right leg portions each further include:
a knee scoop positioned at said outer knee portion, said knee scoop having:
an outer flap; and
an inner flap, said outer and inner flaps extending generally horizontal and each having:
opposite sides, said opposite sides of said outer and inner flaps being connected together and said outer flap being longer side to side than said lower flap.

17. The air cooled protective garment as defined in claim 16 wherein said pants further include:
a crotch portion between said left and right leg portions; and
a closely woven panel positioned through said abrasion resistant, generally impervious, outer layer at said crotch portion which extends on said front side down said inner thigh portion toward said inner knee portion and upward to said top portion and which extends on said back side down said inner thigh portion toward said inner knee portion.

18. The air cooled protective garment as defined in claim 17 wherein said left and right leg portions each further include:
a closely woven panel positioned through said abrasion resistant, generally impervious, outer layer at said respective inner calf.

19. An air cooled protective garment for a motorcyclist including:
a jacket having:
right and left shoulder portions;
an abrasion resistant outer layer; and
right and left scoops positioned at said right and left shoulder portions respectively, each scoop having:
an upper flap; and
a lower flap, said upper and lower flaps each having:
a right side; and
a left side, said right sides of said upper and lower flaps being connected together, said left sides of said upper and lower flaps being connected together, and said upper flap from said right side thereof to said left side thereof being longer than said lower flap from said right side thereof to said left side thereof.

20. The air cooled protective garment as defined in claim 19 wherein said lower flap of each scoop further has:
a trailing edge which defines a throat with said upper flap, said trailing edge being loosely supported by said right and left sides so that said trailing edge can respond to venturi effects of air passing therethrough to reduce the area of said throat at high air velocities.

21. The air cooled protective garment as defined in claim 20 wherein each scoop further includes:

a flexible screen which extends from said upper flap to said trailing edge of said lower flap.

22. The air cooled protective garment as defined in claim 20 wherein each scoop further includes:

fastener means on said upper and lower flaps for selectively holding said upper and lower flaps together.

23. The air cooled protective garment as defined in claim 19 wherein said jacket further includes:

a waist portion; and a back portion including:

right and left reinforced portions extending from said right and left shoulder portions to said waist portion to define an air channel from said right and left scoops down said back portion to said waist portion.

24. The air cooled protective garment as defined in claim 23 wherein said jacket further includes:

right and left sleeves, said back portion further including:

right and left gussets adjacent said right and left sleeves and said right and left shoulder portions, whereby said right and left gussets allow said back portion to billow between said right and left reinforced portions.

* * * * *